US010500631B2

(12) United States Patent
Yuan

(10) Patent No.: US 10,500,631 B2
(45) Date of Patent: Dec. 10, 2019

(54) ONE-HAND HANDLED RIVETER

(71) Applicant: Yuyao Tangwen Tool Co., Ltd., Yuyao (CN)

(72) Inventor: Jianming Yuan, Yuyao (CN)

( * ) Notice: Subject to any disclaimer, the term of this patent is extended or adjusted under 35 U.S.C. 154(b) by 257 days.

(21) Appl. No.: 15/375,086

(22) Filed: Dec. 11, 2016

(65) Prior Publication Data

US 2018/0141108 A1 May 24, 2018

(30) Foreign Application Priority Data

Nov. 24, 2016 (CN) ..... 2016 1 1067336
Nov. 24, 2016 (CN) ..... 2016 2 1287104 U

(51) Int. Cl.
*B21J 15/10* (2006.01)
*B21J 15/38* (2006.01)

(52) U.S. Cl.
CPC ..... *B21J 15/105* (2013.01); *B21J 15/383* (2013.01); *B21J 15/386* (2013.01)

(58) Field of Classification Search
CPC ..... B21J 15/105; B21J 15/383; B21J 15/386; B25B 7/00; B25B 7/20; B25B 7/22; B25B 27/00; B25B 27/02
See application file for complete search history.

(56) References Cited

U.S. PATENT DOCUMENTS 3,280,615 A * 10/1966 Molitor ..... B21J 15/043 279/28
3,324,700 A * 6/1967 Elliott ..... B21J 15/043 29/243.528
3,328,985 A * 7/1967 Keymer ..... B21J 15/043 29/243.528
3,426,572 A * 2/1969 Lahnston ..... B21J 15/043 29/243.528
3,596,496 A * 8/1971 La Pointe ..... B21J 15/043 29/243.521

(Continued)

*Primary Examiner* — Tyrone V Hall, Jr.
(74) *Attorney, Agent, or Firm* — W&K IP

(57) ABSTRACT

The present invention discloses a one-hand handled riveter, which includes a housing with a left handle on the bottom, and a right handle. The mentioned left handle and right handle are all covered by a handle cover. The mentioned housing is installed with a rivet head and the rivet head is equipped with a pull rod on the rear end. The right handle is connected to the pull rob by the top end. Both sides of the top end of the right handle, are equipped with a support arm. The support arms are connected with the pull rod through a positioning shaft by the top end, and the two support arms are connected to a connecting rod through a pin shaft by the bottom end. And a connecting shaft is arranged to the end of the two connecting rod far away from the support arm. Two L-shaped connecting pieces are respectively connected to two ends of the connecting shaft. A connecting hole is arranged to the front and rear ends of the L-shaped connecting piece, and the connecting shaft passes one of the holes. And the rear end of the L-shaped connecting piece is connected to the fixing seat on the rear end of the pull rod by screw connection. The invention can achieve the working mode for screw riveter and nut riveter by selecting the installation position of the connecting hole on the L-shaped connecting piece.

5 Claims, 9 Drawing Sheets

(56) References Cited

U.S. PATENT DOCUMENTS

| | | | | | |
|---|---|---|---|---|---|
| 3,842,649 | A * | 10/1974 | Di Maio | B21J 15/04 | 29/243.528 |
| 4,147,047 | A * | 4/1979 | Fluester | B21J 15/043 | 72/114 |
| 4,344,311 | A * | 8/1982 | Inoue | B21J 15/043 | 29/243.528 |
| 4,347,729 | A * | 9/1982 | Mitani | B21J 15/043 | 29/243.528 |
| 4,353,239 | A * | 10/1982 | Fujimoto | B21J 15/043 | 29/243.528 |
| 4,807,460 | A * | 2/1989 | Tzong | B21J 15/043 | 29/243.528 |
| 5,437,085 | A * | 8/1995 | Liu | B21J 15/386 | 227/55 |
| 6,085,400 | A * | 7/2000 | Liu | B21J 15/043 | 227/55 |
| 6,115,900 | A * | 9/2000 | Cerulo | B21J 15/043 | 29/243.521 |
| 6,588,246 | B2 * | 7/2003 | Ko | B21J 15/043 | 29/243.528 |
| 2014/0137379 | A1 * | 5/2014 | Yuan | B21J 15/386 | 29/243.521 |

* cited by examiner

ONE-HAND HANDLED RIVETER

CROSS-REFERENCE TO RELATED APPLICATIONS

This application claims priority benefit of Chinese Patent Application No. 201611067336.5 with a filing date of Nov. 24, 2016 and Chinese Patent Application No. 201621287104.6 with a filing date of Nov. 24, 2016. The content of the aforementioned applications, including any intervening amendments thereto, are incorporated herein by reference.

TECHNICAL FIELD

The present application relates to the field of riveting tools, and specifically it is a one-hand handled riveter.

BACKGROUND OF THE PRESENT INVENTION

Riveter is used for fastening and riveting of sheet metal, pipes and other manufacturing industries, and now it is widely used for riveting of elevators, switches, instruments, furniture, decorations and other mechanical and electrical products as well as light industry.

The common riveters usually include screw riveter and nut riveter, and the difference between screw riveter and nut riveter is that they have different arms of force for the opening of handles. Screw riveter will have the minimum arm of force when its handles are opened, and it will have the maximum arm of force when its handles are closed, while it is just opposite for nut riveter. Therefore, two kinds of riveters are needed when it needs to rivet screws and nuts at the same time.

Therefore, how to develop a one-hand handled riveter for both riveting screws and nuts is a research focus of people working in this field.

SUMMARY OF PRESENT INVENTION

In view of the deficiencies of the existing technology, the object of the present invention is to provide a one-hand handled riveter, which can be used both for riveting screws and nuts.

The technology solution is as follows: the mentioned one-hand handled riveter includes a housing with a left handle on the bottom, and a right handle. The mentioned left handle and right handle are all covered by a handle housing. The mentioned cover housing is installed with a rivet head and the rivet head is equipped with a pull rod on the rear end. The right handle is connected to the pull rob by the top end. Both sides of the top end of the right handle are equipped with a support arm. The support arms are connected with the pull rod through a positioning shaft by the top end, and the two support arms are connected to a connecting rod through a pin shaft by the bottom end. And a connecting shaft is arranged to the end of the two connecting rod far away from the support arm. Two L-shaped connecting pieces are respectively connected to two ends of the connecting shaft. A connecting hole is arranged to the front and rear ends of the L-shaped connecting piece, and the connecting shaft passes one of the holes. And the rear end of the L-shaped connecting piece is connected to the fixing seat on the rear end of the pull rod by screw connection.

Further, the mentioned housing is connected to the rivet head through thread connection by the front end, and the housing is fixed to the L-shaped connecting piece through screw connection by the rear end. And a lock slot is arranged in the housing for the fixing of L-shaped connecting piece.

Further, the mentioned rivet head includes a fixing, seat fixed at the rear end of the pull rod and the adjusting sleeve installed at the front end of the housing through thread connection. The mentioned pull rod is fixed inside the central hole of the fixing seat by the rear end. The mentioned adjusting sleeve is equipped with a guiding nibble at the front end, and the mentioned pull rod is equipped with a grabbing mechanism by the front end. The mentioned L-shaped connecting piece has a front connecting hole and a rear connecting hole on the front and rear end respectively.

Further, when the mentioned connecting shaft passes through the connecting hole on the front end of L-shaped connecting piece, the connecting shaft will be at the left side of the pin shaft.

The mentioned grabbing mechanism includes the grabbing piece. grabbing seat, ejector pin and return spring. The mentioned grabbing piece is inside the grabbing seat, and the grabbing seat is connected to the pull rod through thread connection by the rear end and housed by the adjusting sleeve. The mentioned grabbing piece, ejector pin and return spring are arranged from left to right and the return spring, is housed in the shaft hole at the front end of the pull rod. The mentioned ejector pin presses the front end of the return spring.

The mentioned connecting shaft is equipped with the first torsion spring and the first torsion spring is connected to the left handle by one end, and its another end stretches out from the rear end of the pull rod.

Further, the mentioned one-hand riveter has the following features: when the mentioned connecting shaft passes through the connecting hole at the rear end of the L-shaped connecting piece, the connecting shaft will be at the right side of the pin shaft.

The mentioned grabbing, mechanism is comprised of nut rivet rod, fixing slide sleeve and spring. The nut rivet rod is housed in the adjusting sleeve by one end, and its another end passes through the guiding nibble. The mentioned fixing slide sleeve is set on the front end of the connecting rod, and the spring is set on the rear end of the fixing slide sleeve and covers the pull rod;

The mentioned pin shaft is equipped with the second torsion spring and the second torsion spring is connected to the right handle by one end, and its another end stretches into the adjusting sleeve.

The one-hand handled riveter provided by the invention has the following advantages: when the riveter is used, L-shaped connecting piece is fixed with the housing, and then the connecting shaft will be fixed by the L-shaped connecting piece. Hence, there is no need to drill holes on the housing directly, and, people can achieve the function of screw riveter and nut riveter by choosing the position of connecting holes passed through by connecting shaft on the front and rear ends of the L-shaped connecting piece due to the different arms of force. In other words, people can achieve the function of screw riveter and nut riveter only with one riveter, so as to facilitate the use.

Parts in the figures: 100—Housing, 1—Left Handle, 2—Right Handle, 21—Support Arm, 3—Left Handle Cover, 4—Right Handle Cover, 5—Rivet Head, 51—Fixing Seat, 52—Adjusting Sleeve, 53—Guiding Nibble, 54—Grabbing Mechanism, 541—Grabbing Piece, 542—Grabbing Seat, 54—Ejector Pin, 544—Return Spring, 54A—Nut Rivet Lever, 54B—Fixing Slide Sleeve, 54C—Spring, 6—Pull Rod, 7—Positioning Shaft, 8—Pin Shaft, 9—Connecting Rod, 10—Connecting Shaft, 11—L-shaped Piece, 121—Front Connecting Hole, 122—Rear Connecting Hole, 13—First Torsion Spring, 14—Second Torsion Spring, 15—Lock Slot.

DETAILED DESCRIPTION OF PREFERRED EMBODIMENTS

Figure 1:
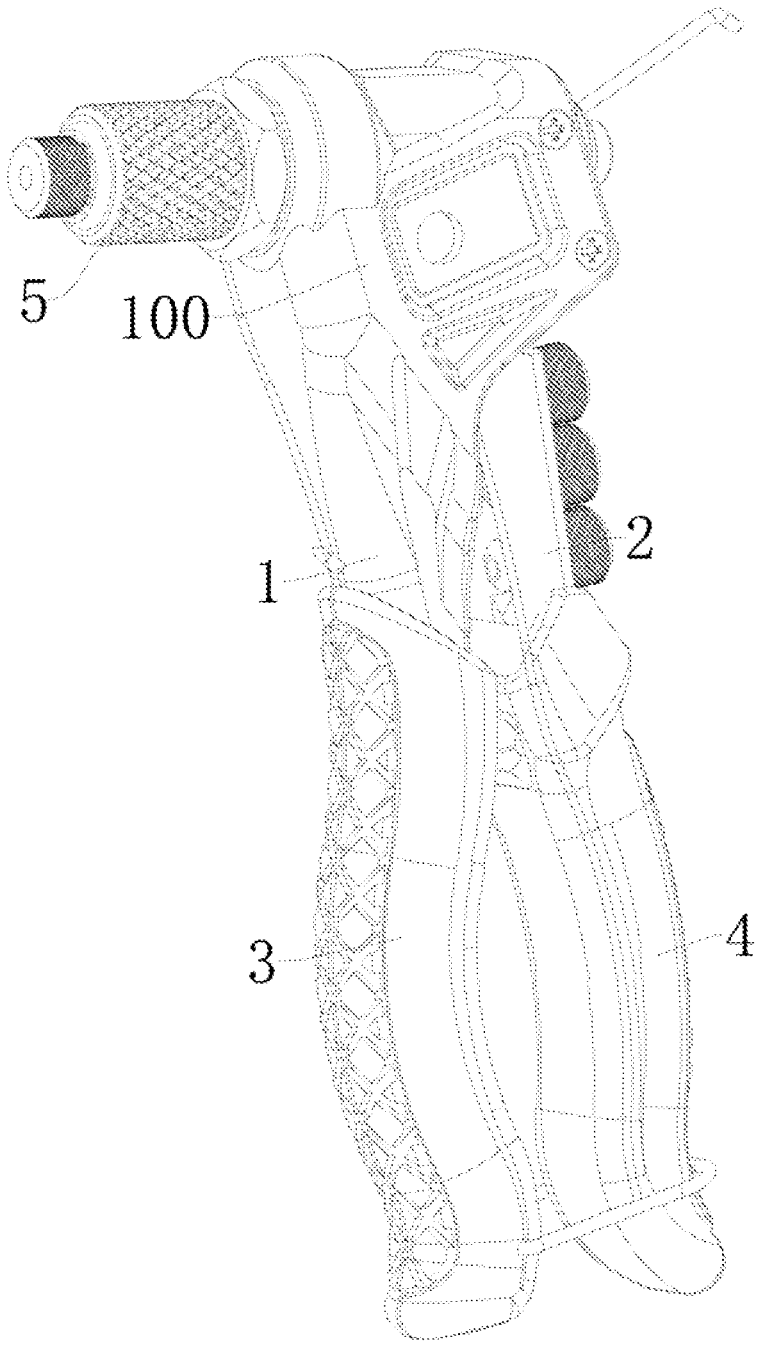
FIG. 1 is the diagram for the overall structure of the invention.
Figure 2:
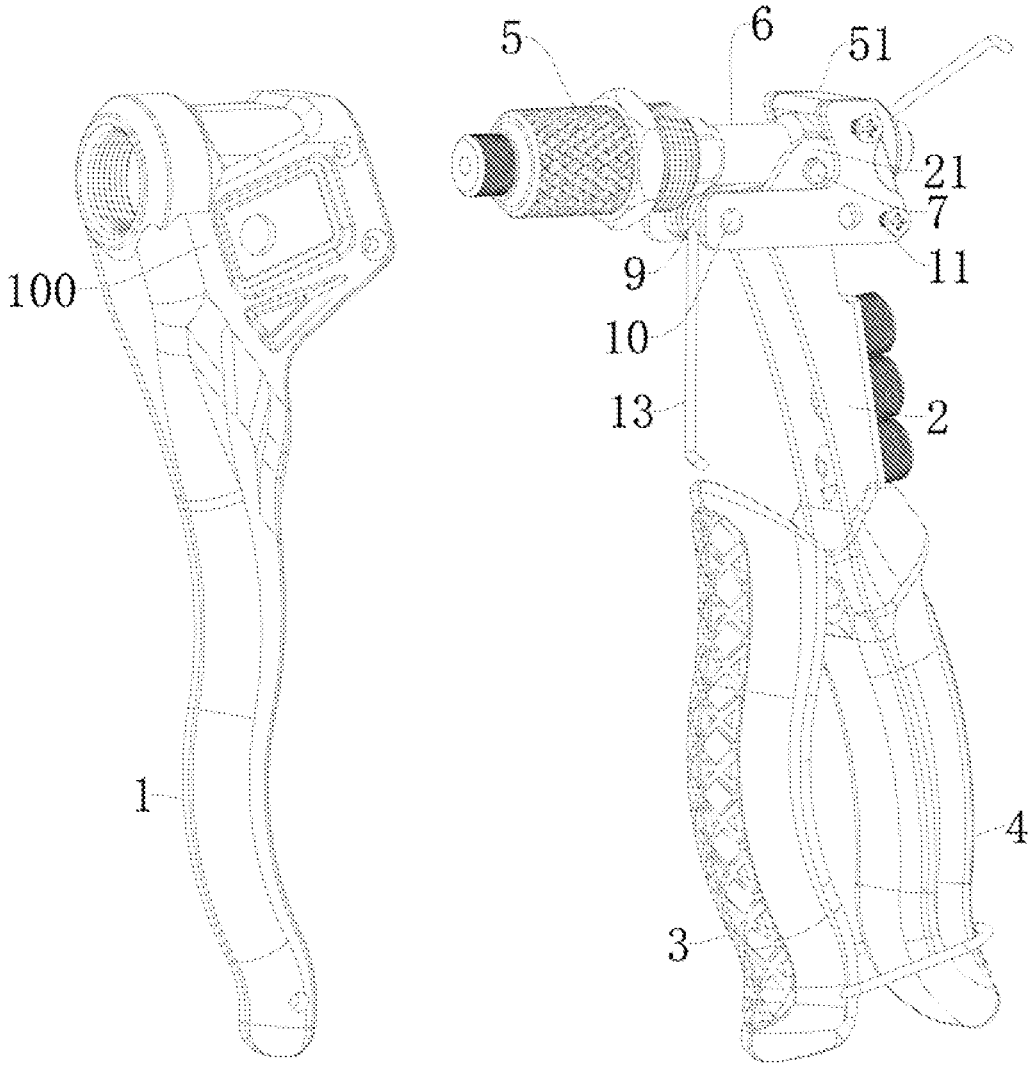
FIG. 2 is the exploded view of Example 1 of the invention.
Figure 3:
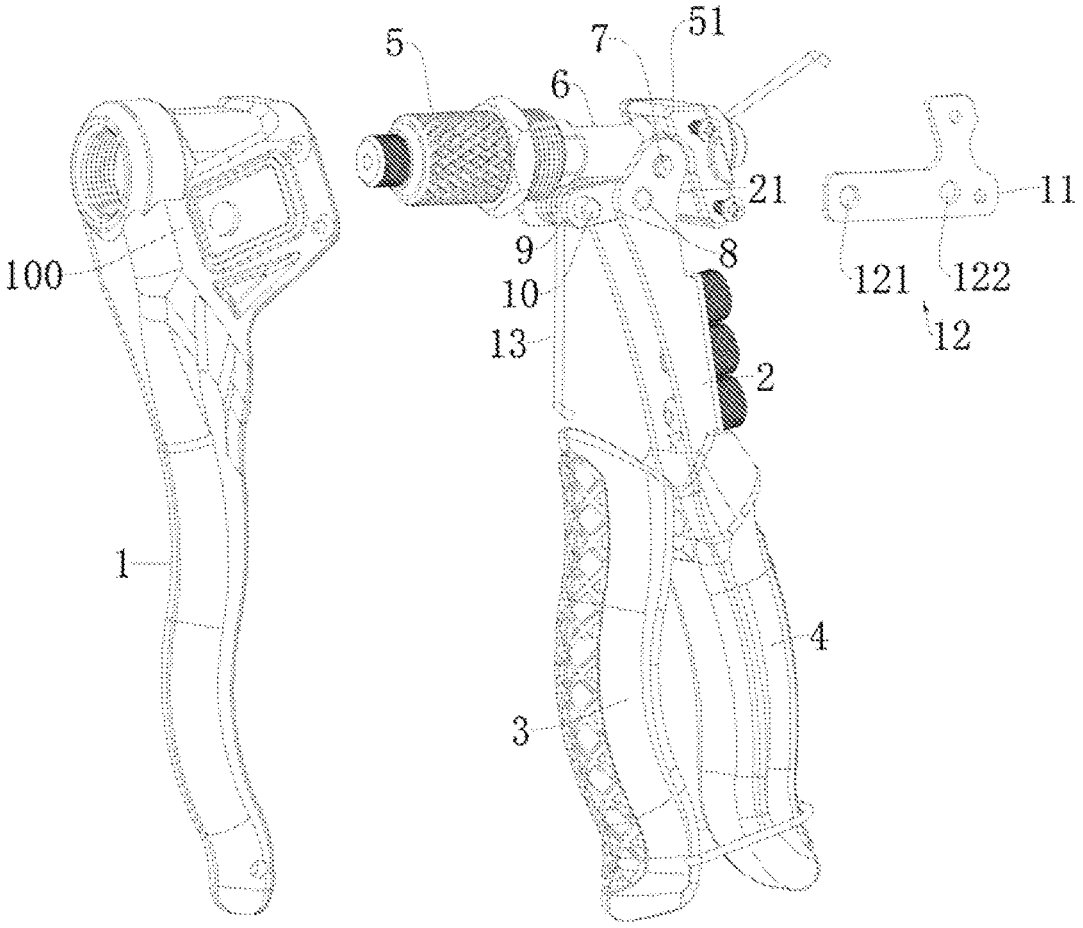
FIG. 3 is another exploded view of Example 1 of the invention.
Figure 4:
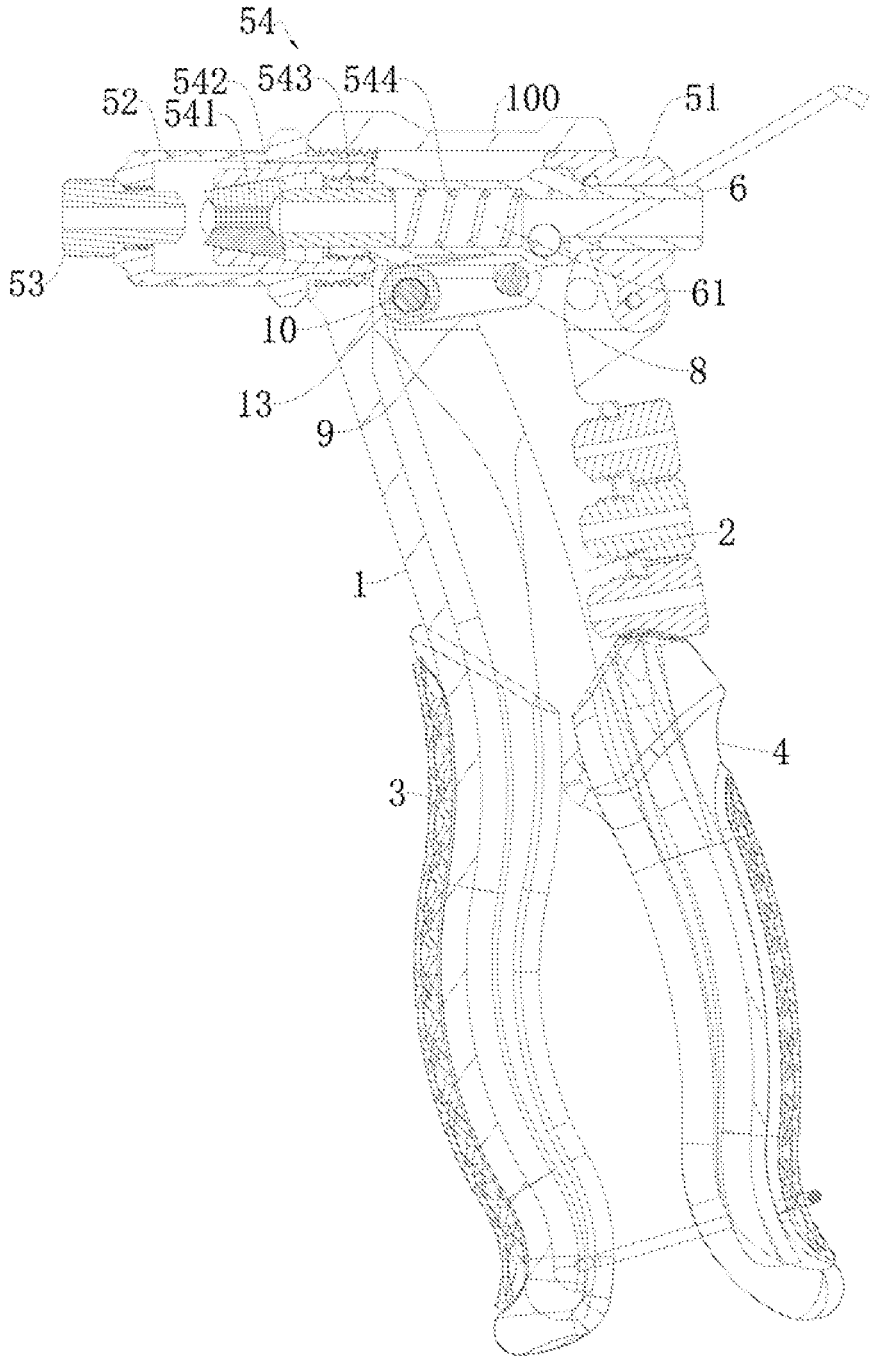
FIG. 4 is the section view of the operation Example 1 of the invention.
Figure 5:
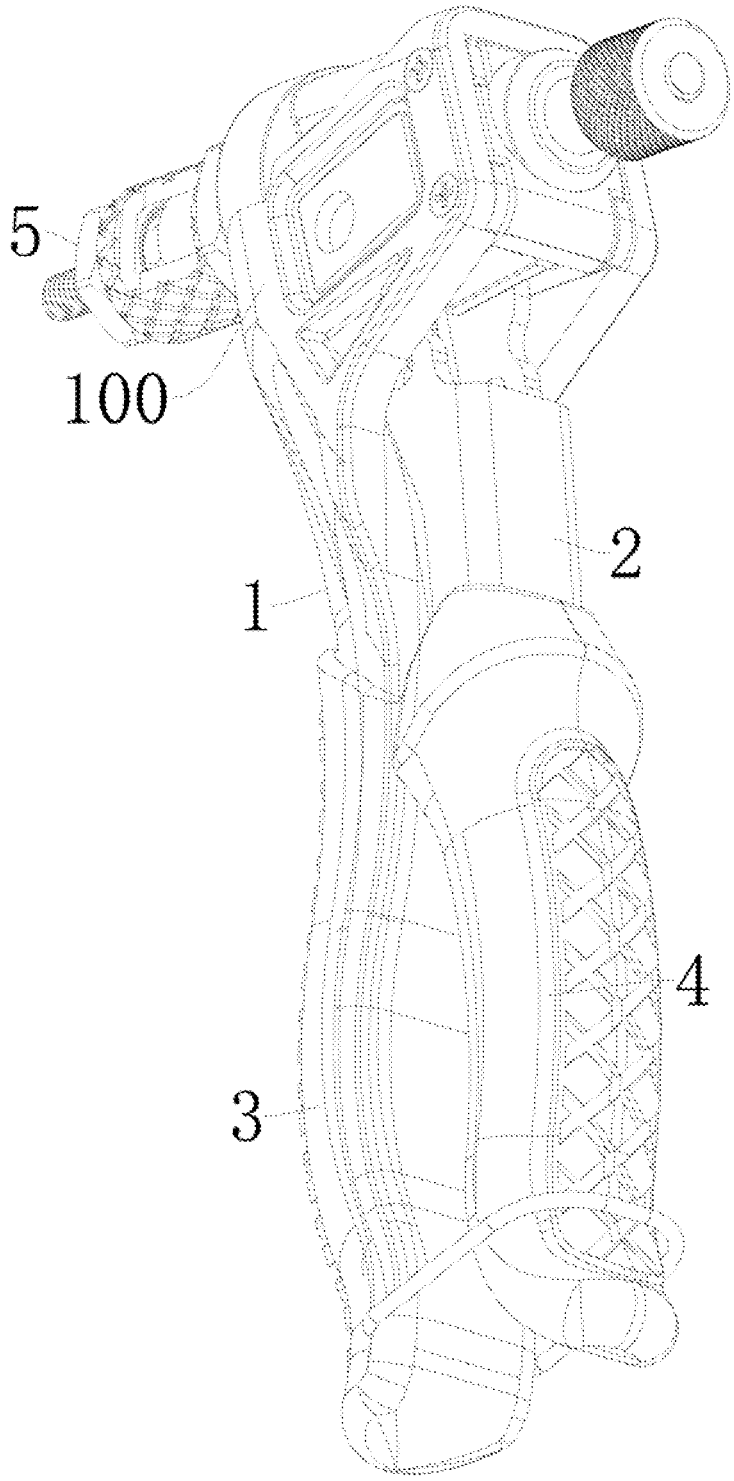
FIG. 5 is the overall structure of the operation Example 2 of the invention.
Figure 6:
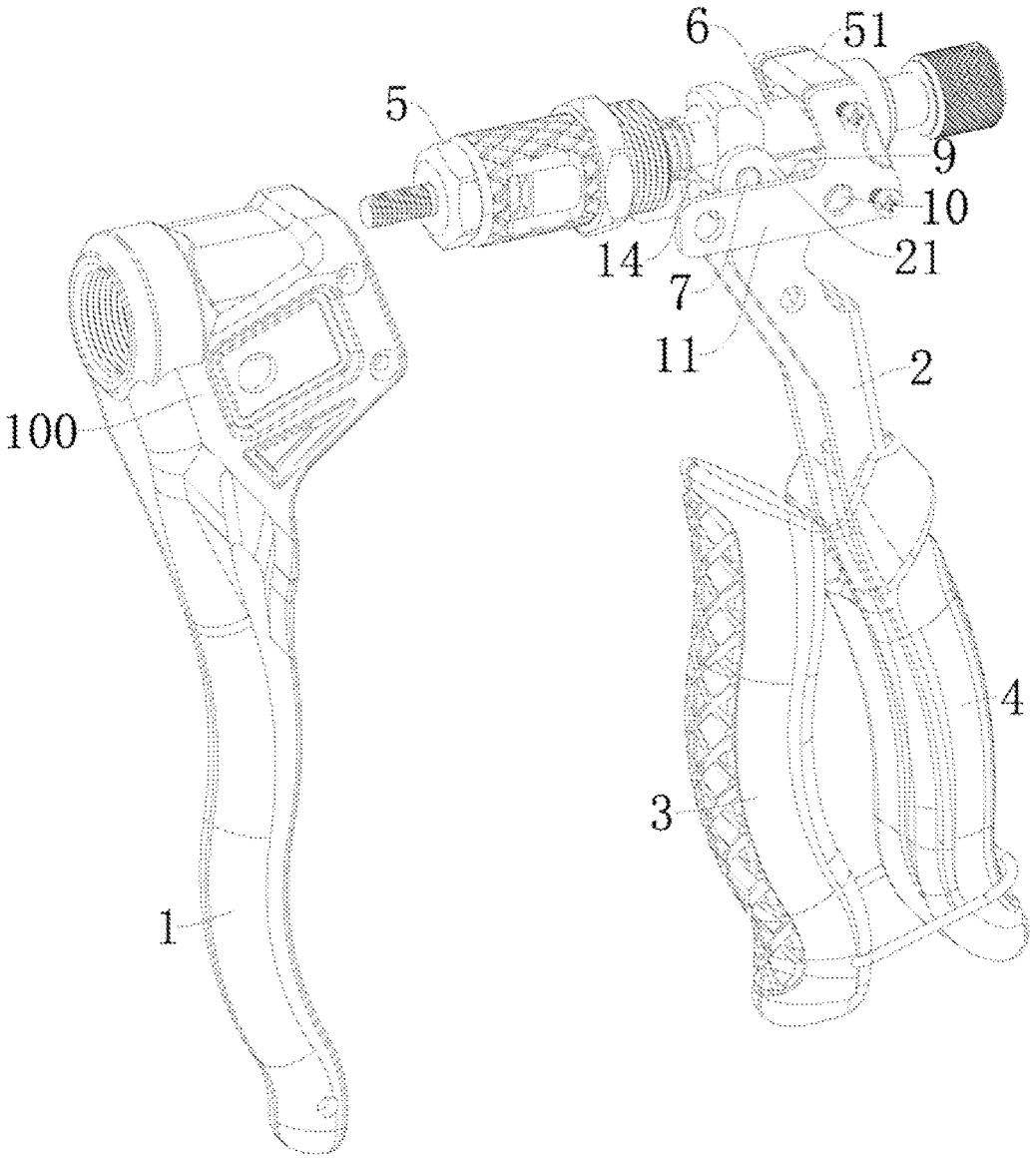
FIG. 6 is the exploded view of the operation Example 2 of the invention.
Figure 7:
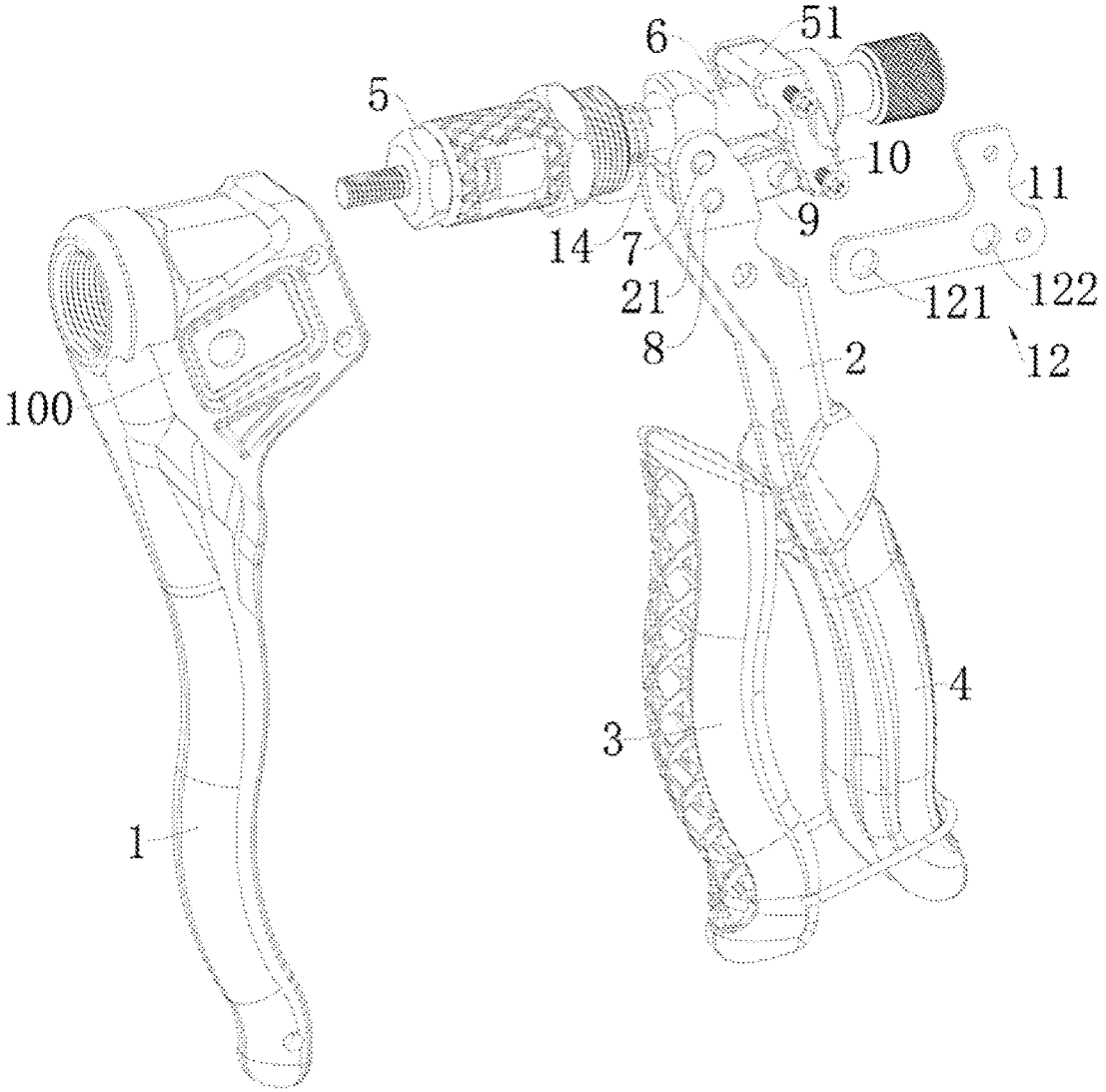
FIG. 7 is another exploded view of the operation Example 2 of the invention.
Figure 8:
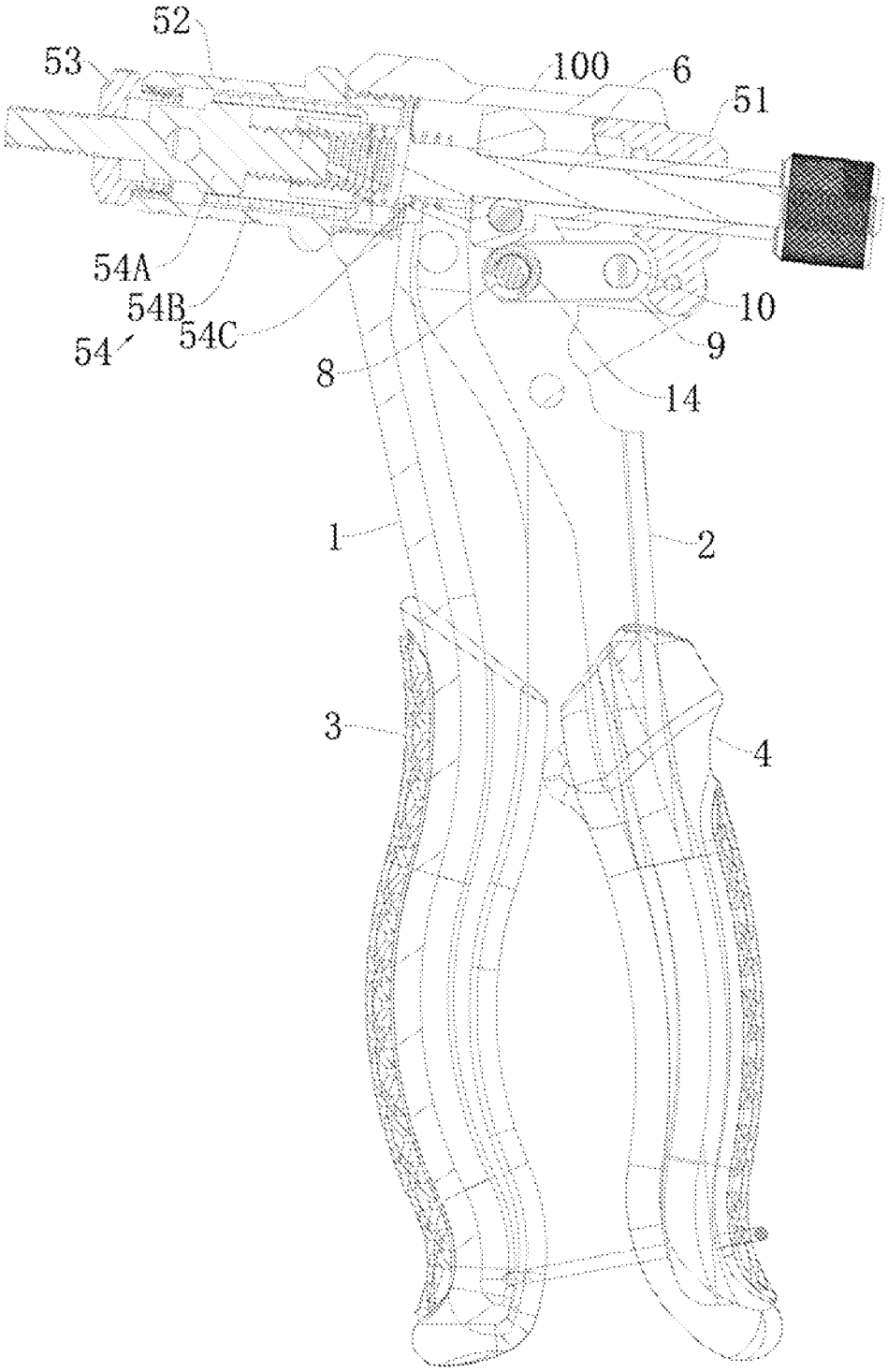
FIG. 8 is the section view of the operation Example 2 of the invention.
Figure 9:
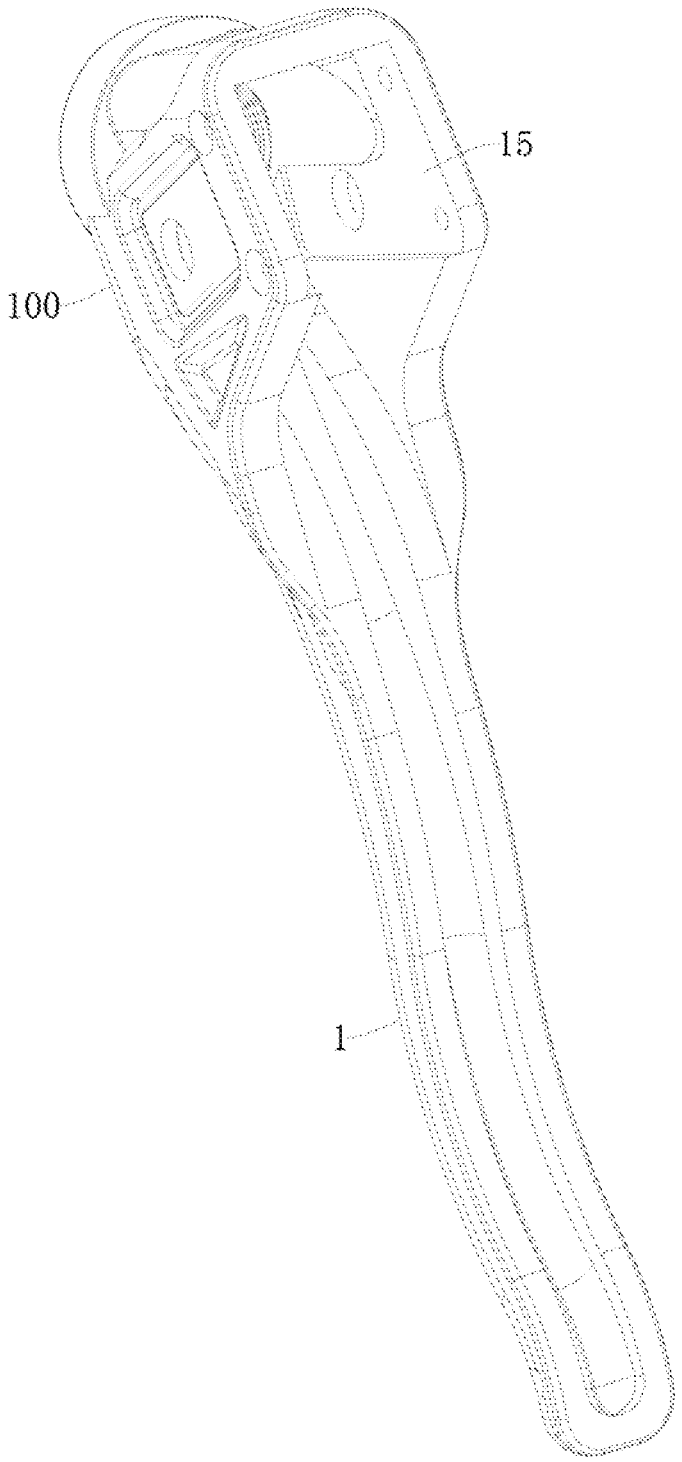
FIG. 9 is the structure diagram of left handle of the invention.

In order to make people have a clearer and more complete understanding of the technical solution of the present invention, here the following non-limiting features are described with the attached figures:

As is shown in FIG. 1 to FIG. 9, the one-hand handled riveter includes a housing 100 with a left handle 1 on the bottom, and aright handle 2. The mentioned left handle 1 and right handle 2 are all covered by a handle housing 3/4. The mentioned cover housing 100 is installed with a rivet head 5 and the rivet head 5 is equipped with a pull rod 6 on the rear end. Right handle 2 is connected to the pull rod 6 by the top end. Both sides of the top end of the right handle 2 is equipped with a support arm 21. The support arms 21 are connected with the pull rod 6 through a positioning shaft 7 by the top end, and the two support arms 21 are connected to a connecting rod 9 through a pin shaft 8 by the bottom end. And a connecting shaft 10 is arranged to the end of the two connecting rod 9 far away from the support arm 21. Two L-shaped connecting pieces 11 are respectively connected to two ends of the connecting shaft 10. A connecting hole 12 is arranged to the front and rear ends of the L-shaped connecting piece 11, and the connecting shaft 10 passes one of the holes 12. And the rear end of the L-shaped connecting piece 11 is connected to the fixing seat 51 on the rear end of the pull rod 6 by screw connection.

The mentioned housing 100 is connected to the rivet head 5 through thread connection by the front end, and the housing 100 is fixed to the L-shaped connecting piece 11 through screw connection by the rear end. And a lock slot 15 is arranged in the housing 100 for the fixing of L-shaped connecting piece 11.

Further, the mentioned rivet head 6 includes a fixing seat 51 fixed at the rear end of the pull rod 6 and the adjusting sleeve 52 installed at the front end of the housing 11 through thread connection. The mentioned pull rod 6 is fixed inside the central hole of the fixing seat 51 by the rear end. The mentioned adjusting sleeve 52 is equipped with a guiding nibble 53 at the front end, and the mentioned pull rod 6 is equipped with a grabbing mechanism 54 by the front end. The mentioned L-shaped connecting piece 11 has a front connecting hole 121 and a rear connecting hole 122 on the front and rear end respectively.

Operation example 1: as is shown in FIG. 1 to FIG. 4 when the mentioned connecting shaft 10 passes through the connecting hole 121 on the front end of L-shaped connecting piece 11, the connecting shaft 10 will be at the left side of the pin shaft 8. The mentioned grabbing mechanism includes the grabbing piece 641, grabbing seat 542, ejector pin 543 and return, spring 544. The mentioned grabbing piece 541 is inside the grabbing, seat 542, and the grabbing seat 542 is connected to the pull rod 6 through thread connection by the rear end and housed by the adjusting sleeve 52. The mentioned grabbing piece 541, ejector pin 543 and return spring 544 are arranged from left to right and the return spring 544 is housed in the shaft hole 61 at the front end of the pull rod 6. The mentioned ejector pin 543 presses the front end of the return spring 544. The connecting shaft 10 is equipped with the first torsion spring 13. The first torsion spring 13 is connected with the left handle 1 by one end, and its another end stretches out from the rear end of pull rod 6.

When the riveter is used, the right handle 2 will be opened to drive the pull rod 6 to move forward, and the connecting shaft 10 will keep fixed, i.e., the connecting shaft 10 serves as a fulcrum of the connecting rod 9 to allow connecting rod 9 to swing. This way, the furthest distance is formed between positioning shaft 7 and pin shaft 8 which serves as the fulcrum for the arm of force of right handle 2, and the arm of force is weakest. While, when right handle 2 is closed, the closest distance is formed between positioning shaft 7 and pin shaft 8 which serves as the fulcrum for the arm of force of right handle 2, and the arm of force is strongest. Operation above is in line with the working principle of screw riveter, so this riveter can serve as the screw riveter.

Operation example 2: as is shown in FIG. 5 to FIG. 8, when the connecting shaft 10 passes through the connecting, hole 122 on the front end of L-shaped connecting piece 11, the connecting shaft 10 will be at the right side of the pin shaft 8. The grabbing mechanism includes the nut rivet rod 54A, fixing slide sleeve 54B and spring 54C. The nut rivet rod 54A is housed in the adjusting sleeve 52 lay one end, and its another end passes through the guiding nibble 53. The fixing slide sleeve 54B is set on the front end of the connecting rod 9, and the spring 54C is set on the rear end of the fixing slide sleeve 54B and covers the pull rod 6. The pin shaft 8 is equipped with the second torsion spring 14 and the second torsion spring 14 is connected to the right handle 2 by one end, and its another end stretches into the adjusting sleeve 52.

When the riveter is used, the right handle 2 will be opened to drive the pull rod 6 to move forward and the connecting shaft 10 will keep fixed, i.e., the connecting shaft 10 serves as a fulcrum of the connecting rod 9 to allow connecting rod 9 to, swing. This way, the closest distance is formed between positioning shaft 7 and pin shaft 8 which serves as the fulcrum for the arm of force of right handle 2, and the arm of force is strongest. While, when right handle 2 is closed, the furthest distance is formed between positioning shaft 7 and pin shaft 8 which serves as the fulcrum for the arm of force of right handle 2, and the arm of force is weakest. Operation above is in line with the working principle of nut riveter, so this riveter can serve as the nut riveter.

Of course, these are only preferred examples of the invention only, and it shall not confine the patentable scope of the present invention. All products which make use of the specification and drawings of the present invention with simple modifications and equivalent structures shall be included in the scope of patent protection of the present invention.

I claim:

1. A one-hand handled riveter, comprising a housing with a left handle on the bottom, and a right handle, wherein the left handle and right handle are both covered by a handle housing, wherein the housing is installed with a rivet head, wherein the rivet head comprises a front end and a rear end, wherein the rivet head is equipped with a pull rod on the rear end of the rivet head, wherein the right handle comprises a top end, wherein the top end of the right handle comprises two sides, wherein the right handle is connected to the pull rod by the top end of the right handle, wherein both sides of the top end of the right handle are equipped with a support arm, wherein each support arm comprise a top end and a bottom end, wherein each support arm is connected with the pull rod through a positioning shaft by the top end of the support arm, wherein each support arm is connected to a connecting rod (9) through a pin shaft by the bottom end of the support arm, wherein each connecting rod comprises two ends, wherein a connecting shaft is arranged to the end of each connecting rod far away from the support arm, wherein the connecting shaft comprises two ends, wherein two L-shaped connecting pieces are respectively connected to the two ends of the connecting shaft, wherein each L-shaped connecting piece comprises a frond end and a rear end, wherein two connecting holes are respectively arranged to the front and rear ends of the L-shaped connecting piece, wherein the connecting shaft passes one of the connecting holes, wherein the pull rod comprises a rear end, and wherein the rear end of the L-shaped connecting piece is connected to a fixing seat on the rear end of the pull rod by screw connection.

2. The one-hand handled riveter according to claim 1, wherein the housing comprises a front end and a rear end, wherein the housing is connected to the rivet head through thread connection by the front end of the housing, wherein a lock slot is arranged in the housing for fixing the L-shaped connecting piece, and wherein the housing is fixed to the L-shaped connecting piece through screw connection by the rear end of the housing.

3. The one-hand handled riveter according to claim 2, wherein the rivet head comprises the fixing seat fixed at the rear end of the pull rod, wherein an adjusting sleeve is installed at the front end of the housing through thread connection, wherein the fixing seat comprises a central hole, wherein the pull rod is fixed inside the central hole of the fixing seat by the rear end of the pull rod, wherein the adjusting sleeve comprises a front end, wherein the adjusting sleeve is equipped with a guiding nibble at the front end of the adjusting sleeve, wherein the pull rod is equipped with a grabbing mechanism by the front end of the pulling rod, wherein the L-shaped connecting piece has a front connecting hole and a rear connecting hole on the front and rear ends, respectively.

4. The one-hand handled riveter according to claim 3, wherein when the connecting shaft passes through the connecting hole on the front end of L-shaped connecting piece, the connecting shaft will be at the left side of the pin shaft (8);

wherein the grabbing mechanism comprises a grabbing piece, a grabbing seat, an ejector pin and a return spring, wherein the grabbing piece is inside the grabbing seat, wherein the grabbing seat is connected to the pull rod through thread connection by the rear end of the pull rod and housed within the adjusting sleeve, wherein the grabbing piece, ejector pin and return spring are arranged from left to right, wherein the return spring is housed in the shaft hole at the front end of the pull rod, wherein the ejector pin presses the front end of the return spring, wherein the connecting shaft is equipped with a first torsion spring, and wherein the first torsion spring is connected to the left handle by one end, and its other end stretches out from the rear end of pull rod.

5. The one-hand handled riveter according to claim 3, wherein when the connecting shaft passes through the connecting hole at the rear end of the L-shaped connecting piece, the connecting shaft will be at the right side of the pin shaft;

wherein the grabbing mechanism comprises a nut rivet rod, a fixing slide sleeve and a spring, wherein the nut rivet rod is housed in the adjusting sleeve by one end, and its another end passes through the guiding nibble, wherein the fixing slide sleeve is set on the front end of the connecting rod, wherein the spring is set on the rear end of the fixing slide sleeve and covers the pull rod, wherein the pin shaft is equipped with a second torsion spring, and wherein the second torsion spring is connected to the right handle by one end, and its another end stretches into the adjusting sleeve.

* * * * *